United States Patent [19]

Roy

[11] Patent Number: 4,979,266

[45] Date of Patent: Dec. 25, 1990

[54] EASEL HINGE

[75] Inventor: Leo T. Roy, South Attleboro, Mass.

[73] Assignee: Craft, Inc., South Attleboro, Mass.

[21] Appl. No.: 380,300

[22] Filed: Jul. 14, 1989

[51] Int. Cl.[5] ..... E05D 11/06

[52] U.S. Cl. ..... 16/376; 16/355; 16/388; 16/274

[58] Field of Search ..... 16/376, 274, 355, 374, 16/387, 388

[56] References Cited

U.S. PATENT DOCUMENTS

| | | | |
|---|---|---|---|
| 1,433,095 | 10/1922 | Pzary | 16/274 |
| 1,593,929 | 7/1926 | Carrier | 16/374 |
| 2,571,633 | 10/1951 | Vogel | 16/388 |
| 2,811,741 | 11/1957 | Miller et al. | 16/376 |
| 3,181,197 | 5/1965 | Sperber | 16/274 |
| 3,994,045 | 11/1976 | Roy | 16/355 |
| 4,050,117 | 9/1977 | Roy | 16/355 |
| 4,063,330 | 12/1977 | Triplette | 16/388 |
| 4,349,942 | 9/1982 | Roy | 16/376 |
| 4,850,082 | 7/1989 | Yi | 16/374 |

*Primary Examiner*—Richard K. Seidel
*Assistant Examiner*—Chuck Y. Mah
*Attorney, Agent, or Firm*—Salter & Michaelson

[57] ABSTRACT

An easel hinge includes first and second hinge plates, each including a substantially flat main portion, a curled or rolled barrel portion and a pair of rosette type fastening elements. The barrel portions of the hinge plates cooperate to hingeably connect the main portions for movement of the hinge between a closed position wherein the main portions are in closely adjacent, substantially parallel relation, and an open position wherein the main portions are in angular relation. The hinge further includes a pair of daps on the main portion of at least one of the hinge plates for maintaining the main portions in closely spaced relation when the hinge is in the closed position thereof so that the hinge can be more effectively plated.

5 Claims, 1 Drawing Sheet

EASEL HINGE

BACKGROUND AND SUMMARY OF THE INVENTION

The instant invention relates to easel hinges and more particularly to an easel hinge which is adapted to be more effectively plated, such as a by black oxide plating solution.

Easel hinges of the general type disclosed in the ROY U.S. Pat. Nos. 3,994,045 and 4,050,117 have generally been found to be highly effective for applications such as hingeably connecting the supporting leg of a picture frame to the backing board of the frame. An easel hinge of this type generally comprises first and second hinge plates, each including a substantially flat main portion and a rolled barrel portion which is integrally attached to the main portion thereof. The barrel portions of an easel hinge of this type are received in pivotable interfitting relation for connecting the hinge plates thereof so that they are hingeable between a closed position wherein the main portions are in substantially parallel, closely adjacent relation and an open position wherein the main portions are in angular relation. An easel hinge of this type generally further comprises a pair of rosette fastening elements on the outwardly facing sides of the hinge plates thereof for securing one of the hinge plates to the backing board of a picture frame and the other hinge plate to the supporting leg of the frame.

Heretofore easel hinges of the above described type have generally been made from steel and in most cases they have had protective black oxide layers and/or corrosion resistant wax coatings on the surface thereof. In this regard, black oxide surface layers have generally been applied to easel hinges of the above described type by immersing them in caustic salt solutions and corrosion resistant wax coatings have generally been applied to hinges by immersing them in liquid baths of corrosion resistant waxes. However, it has been found that in many cases unless the main portions of the hinge plates of an easel hinge are maintained in spaced relation when the hinge is immersed in a caustic salt solution, residual amounts of caustic salt solution can be left on the main portions even after rinsing. It has been further found that this can generally cause the main portions to later rust or corrode. Further, it has been found that unless the main portions of the hinge plates of a hinge are spaced apart when the hinge is immersed in a corrosion resistant wax, the wax generally fails to properly coat the mating surfaces of the main portions. Accordingly, the uncoated portions of the mating surfaces often have increased levels of susceptibility to rust and corrosion.

The instant invention effectively overcomes the above disadvantages of the heretofore available easel hinges by providing an effective easel hinge wherein the mating surfaces of the main portions of the hinge plates thereof are maintained in slightly spaced relation when the hinge is in a closed position. Accordingly, the hinge of the subject invention is adapted to permit a coating solution, such as a caustic salt solution, to be effectively rinsed from the hinge plates and it is also adapted to permit the mating surfaces of the main portions to be effectively coated with a corrosion resistant wax coating. Specifically, the easel hinge of the subject invention comprises first and second hinge plates having first and second main portions and first and second barrel portions, respectively. The first and second main portions have first and second mating surfaces thereon, respectively, and the first and second barrel portions cooperate to hingeably connect the hinge plates so that they are hingeable about a hinge axis between a closed position wherein the mating surfaces are in closely adjacent, substantially parallel relation, and an open position wherein the mating surfaces are in angular relation. The easel hinge of the subject invention further comprises dap means on at least one of the mating surfaces for maintaining the main portions of the hinge plates in spaced relation when the hinge is in the closed position. The dap means preferably comprises a pair of daps which are preferably both disposed on the same hinge plate and the daps are preferably positioned so that they are spaced in a direction substantially parallel to the hinge axis. The easel hinge preferably further comprises first and second pairs of rosette fastening elements on the outwardly facing sides of the main portions of the first and second hinge plates and the fastening elements on each hinge plate are preferably also spaced in a direction substantially parallel to the hinge axis. Further, each of the daps is preferably formed and positioned so that it encircles an aperture in one of the rosette fastening elements on the inwardly facing mating surface of a hinge plate. Still further, the first barrel portion is preferably received in encircling relation around the second barrel portion and the first barrel portion preferably has at least one drain hole therein for draining liquid, such as coating solution, from between the first and second barrel portions.

It has been found that the easel hinge of the instant invention can be effectively immersed in a coating solution, such as a caustic salt solution, and that because the daps maintain the main portions of the hinge plates in closely spaced relation, residual amounts of coating solution can be effectively washed from the surfaces thereof. Further, because the first barrel portion preferably has at least one drain hole therein, plating solution can be effectively washed from between the first and second barrel portions. Still further, because the main portions of the hinge plates are maintained in closely spaced relation when they are in the closed positions thereof, a corrosion resistant wax can be more effectively applied to the mating surfaces of the hinge plates.

The closest prior art to the subject invention of which the applicant is aware is disclosed in the aforementioned U.S. Patents to ROY and the CIRELLI U.S. Pat. No. 3,984,900. However, these references fail to suggest the concept of providing daps on the mating surfaces of the hinge plates of an easel hinge in order to maintain the mating surfaces of the hinge plates in spaced relation during a plating and/or coating operation and hence, they are believed to be of only general interest with respect to the subject invention Accordingly, it is a primary object of the instant invention to provide an easel hinge which is adapted to be effectively immersed in a coating or plating solution.

Another object of the instant invention is to provide an easel hinge which is adapted to maintain the hinge plates thereof in closely spaced relation when they are in the closed positions thereof.

An even further object of the instant invention is to provide an easel hinge comprising first and second hinge plates, first and second pairs of rosette fastening elements on the first and second hinge plates, respectively, and a pair of daps on the inwardly mating surface of at least one of the hinge plates which encircle the apertures in the rosette fastening elements on the same hinge plate.

An even further object of the instant invention is to provide an easel hinge comprising first and second hinge plates, including first and second barrel portions, respectively, wherein the first barrel portion encircles the second barrel portion and has a drain hole formed therein.

Other objects, features and advantages of the invention shall become apparent as the description thereof proceeds when considered in connection with the accompanying illustrative drawings.

DESCRIPTION OF THE DRAWING:

In the drawing which illustrates the best mode presently contemplated for carrying out the present invention.

DESCRIPTION OF THE INVENTION

Figure 1:
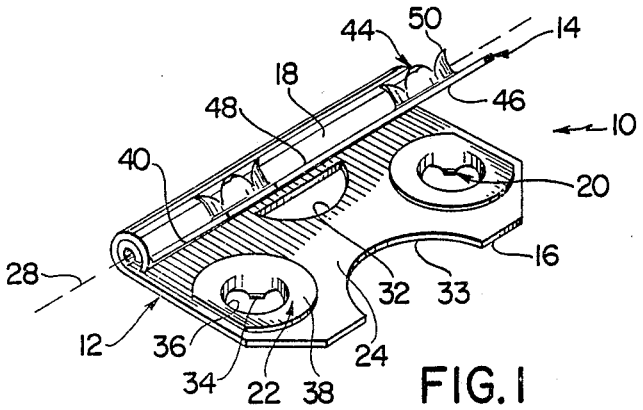
FIG. 1 is a perspective view of the easel hinge of the instant invention in an open position.
Figure 2:
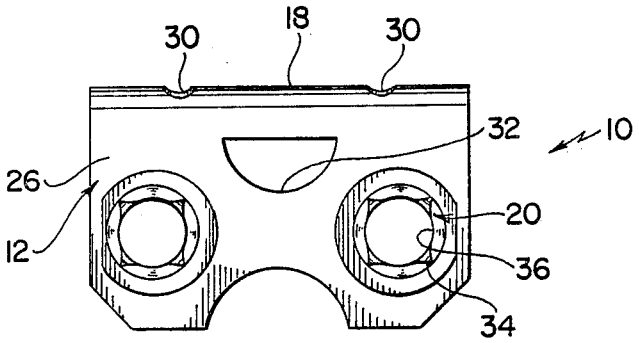
FIG. 2 is a top plan view thereof in a closed position.
Figure 3:
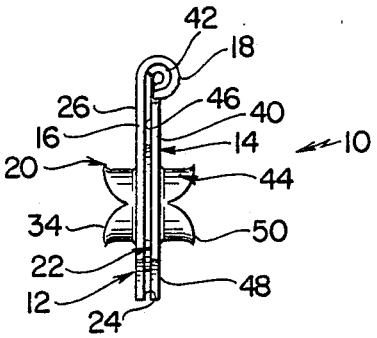
FIG. 3 is an end elevational view thereof in the closed position.

Referring now to the drawing, the easel hinge of the instant invention is illustrated in FIGS. 1 through 3 and is generally indicated at 10. The easel hinge 10 includes first and second hinge plates generally indicated at 12 and 14, respectively, which are hingeably connected so that they are alternatively positionable in the closed position illustrated in FIGS. 2 and 3 or the open position illustrated in FIG. 1.

The first hinge plate 12 is preferably integrally formed from a suitable sheet metal, such as steel, and it includes a substantially flat main portion 16, a barrel portion 18, a pair of rosette fastening elements 20, and a pair of daps 22. The main portion 16 includes mating and outer surfaces 24 and 26, respectively, and the barrel portion 18 is formed as an elongated substantially straight member which is rolled or curled about a hinge axis 28. A pair of spaced drain holes 30 is formed in the barrel portion 18 and an opening 32 is formed in the main portion 16 adjacent to the barrel portion 18. The rosette fastening elements 20 are of conventional configuration and they each include a plurality of prongs 34 which extend outwardly from the outer surface 26 around an aperture 36. As illustrated, the rosette fastening elements 20 are positioned on the main portion 16 so that they are spaced apart in a direction substantially parallel to the axis 28. The daps 22, are located on the mating surface 24 and they are formed as ring-like bosses which encircle the apertures 36. The daps 22 are further formed so that they include substantially flat faces 38 which are substantially parallel to and spaced outwardly slightly from the mating surface 24.

The second hinge plate 14 is preferably also made from a suitable sheet metal, such as steel and it is generally similar in configuration to the first hinge plate 12. The second hinge plate 14 includes a substantially flat main portion 40, a barrel portion 42, and a pair of rosette fastening elements generally .indicated at 44. The main portion 40 is generally similar to the main portion 24 and it includes mating and outer surfaces 46 and 48, respectively. As herein embodied, the second hinge plate 14 does not include daps 38 on the mating surface 46 thereof, although other embodiments thereof which do include daps are contemplated., The barrel portion 42 is formed along one edge of the main portion 40 as an elongated rolled or curled member of reduced diameter and it is received in the interior of the barrel portion 18. In this regard, the barrel portions 18 and 42 are preferably formed in a manner similar to the corresponding barrel portions of the easel hinge disclosed in the ROY U.S. Pat. No. 4,050,117 and they cooperate to connect the hinge plates 12 and 14 so that they are pivotable between the closed position illustrated in FIGS. 2 and 3 wherein the hinge plates 12 and 14 are in substantially parallel closely adjacent relation, and the open position illustrated in FIG. 1 wherein the hinge plates 12 and 14 define an angle of approximately 30° therebetween. The rosette fastening elements 44 are preferably identical to the rosette fastening elements 20 on the first hinge plate 12 and they each include a plurality of prongs 50 which extend outwardly from the outer surface 48 around an aperture (not shown) in the main portion 40. Further, the rosette fastening elements 44 are preferably positioned so that they are spaced in a direction substantially parallel to the axis 28 and so that the apertures therein are substantially aligned with the apertures 36 in the first hinge plate 12 when the hinge 10 is in the closed position thereof.

The hinge 10 is adapted to be effectively coated with a suitable coating, such as a black oxide coating, by immersing it in a caustic salt solution. In this regard, because the hinge plate 12 includes the daps 22 on the mating surface 24 thereof, the main portions 16 and 40 are maintained in closely spaced substantially parallel relation when the hinge 10 is in the closed position thereof. Hence, caustic salt solution can more effectively pass between the main portions 16 and 40 and it can also be more easily rinsed from the main portions 16 and 40 when the hinge 10 is immersed in a suitable rinse solution. Further, because the first barrel portion 18 has a pair of drain holes 30 formed therein, a caustic solution and/or a rinse solution can be effectively drained from between the barrel portions 18 and 42. Still further, once the hinge 10 has been plated, it can be more effectively immersed in a suitable molten corrosion resistant wax to further coat the plate portions 12 and 14. In particular, because the hinge plate 12 includes the daps 22, the main portions 16 and 40 are maintained in closely spaced relation when the hinge 10 is in the closed position thereof so that liquid wax coating material can pass between the main portions 16 and 40. Still further, because the daps 22 are spaced in a direction substantially parallel to the axis 28, the plate portions 12 and 14 are highly stable and they do not tend to pivot or rock from side to side on the daps 22 when the hinge 10 is in the closed position thereof.

It is seen therefore that the instant invention provides an easel hinge which is adapted to be effectively coated by immersing it in a coating or plating liquid, such as a caustic salt solution or a corrosion resistant liquid wax. The daps 22 effectively maintain the main portions 16 and 40 in spaced relation when the hinge 10 is in the closed position thereof to permit liquid to freely drain from between the main portions 16 and 40. Accordingly, coatings, such as black oxide layers or wax coatings can be effectively applied to the hinge 10 so that it has a reduced level of susceptibility to rust and/or corrosion. For these reasons, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In an easel hinge of type including first and second hinge plates having substantially flat first and second main portions, respectively, and first and second barrel positions, on said first and second main portions, respectively, said first and second main portions having first and second mating surfaces thereon, respectively, said first and second barrel portions cooperating to hingeably connect said first and second hinge plates so that said hinge plates are hingeable about a hinge axis between a closed position wherein said first and second mating surfaces are in closely adjacent substantially parallel relation and an open position wherein said first and second mating surfaces are in angular relation, said first and second plate portions also having first and second outer surfaces thereon, respectively, which face outwardly away from said first and second mating surfaces, respectively, said easel hinge further comprising first and second pairs of rosette fastening elements on said first and second plate portions, respectively, said rosette fastening elements having central apertures therein and projecting outwardly from said first and second outer surfaces, respectively, the rosette fastening elements of each pair of fastening elements being spaced in a direction substantially parallel to said hinge axis, the improvement comprising dap means on at least one of said mating surfaces for maintaining said first and second main portions in spaced relation when said hinge is in said closed position, said dap means comprising a pair of daps which are spaced in a direction substantially parallel to said axis, each of said daps encircling one of said apertures.

2. In the easel hinge of claim 1, said daps being on the same mating surface.

3. In the easel hinge of claim 1, each of said daps having a substantially flat face thereon which is substantially parallel to the respective mating surface thereof.

4. In the easel hinge of claim 1, said first barrel portion being receivable in substantially encircling relation around said second barrel portion for hingeable connecting said first and second barrel portions together, said first barrel portion having at least one drain hole therein for draining liquid from between said first and second barrel portions.

5. In the easel hinge of claim 1, said first and second hinge plates further characterized as metal hinge plates having a black oxide coating thereon.

* * * * *